US010843090B2

(12) United States Patent
Van Heijster

(10) Patent No.: US 10,843,090 B2
(45) Date of Patent: Nov. 24, 2020

(54) SUSPENDED ROLLERCOASTER VEHICLE WITH ROTATIONAL LOCKAGE

(71) Applicant: VEKOMA RIDES ENGINEERING B.V., Vlodrop (NL)

(72) Inventor: Arno Johannes Petronella Van Heijster, Heythuysen (NL)

(73) Assignee: VEKOMA RIDES ENGINEERING B.V., Vlodrop (NL)

( * ) Notice: Subject to any disclaimer, the term of this patent is extended or adjusted under 35 U.S.C. 154(b) by 0 days.

(21) Appl. No.: 16/614,197

(22) PCT Filed: May 16, 2018

(86) PCT No.: PCT/NL2018/050324
§ 371 (c)(1),
(2) Date: Nov. 15, 2019

(87) PCT Pub. No.: WO2018/212652
PCT Pub. Date: Nov. 22, 2018

(65) Prior Publication Data

US 2020/0086221 A1 Mar. 19, 2020

(30) Foreign Application Priority Data

May 17, 2017 (NL) ..... 2018935

(51) Int. Cl.
*A63G 21/20* (2006.01)
*A63G 21/04* (2006.01)

(52) U.S. Cl.
CPC ..... *A63G 21/20* (2013.01); *A63G 21/04* (2013.01)

(58) Field of Classification Search
CPC ..... A63G 21/04; A63G 21/20; A63G 7/00; A63G 21/08; A63G 27/02; A63G 27/08; A63G 1/00; A63G 23/00
See application file for complete search history.

(56) References Cited

U.S. PATENT DOCUMENTS 6,095,926 A * 8/2000 Hettema ..... A63G 31/16 104/85
6,220,965 B1 * 4/2001 Hanna ..... A63G 7/00 463/52

(Continued)

FOREIGN PATENT DOCUMENTS

EP 1 201 280 A2 5/2002
EP 1 201 280 B1 4/2008

OTHER PUBLICATIONS

Dutch Search Report, issued in Priority Application No. 2018935, dated Jan. 31, 2018.

(Continued)

*Primary Examiner* — Mark T Le
(74) *Attorney, Agent, or Firm* — Birch, Stewart, Kolasch & Birch, LLP

(57) ABSTRACT

An amusement device includes a substructure with a passenger seat, which is rotatable relative to a main structure by a bearing and a coupling. The coupling has a coupling ring and a coupling actuator for driving the substructure about a coupling axis C-C. The coupling ring has an end face which is toothed to engage with a toothed end face of a lock element of a lockage for rotationally locking the coupling ring with respect to the main structure. The lock element is axially movable and rotationally constrained with respect to an lockage actuator. A spring and electromagnet respectively serve for axially moving the lock element. During a normal ride, the lockage is open and all kind of rotations are possible, but in case of an interference the lockage engages for safety.

20 Claims, 3 Drawing Sheets

(56) References Cited

U.S. PATENT DOCUMENTS

| | | | | |
|---|---|---|---|---|
| 6,776,722 | B2 * | 8/2004 | De-Gol | A63G 31/16 434/55 |
| 2012/0149480 | A1 * | 6/2012 | Crawford | A63G 27/02 472/130 |

OTHER PUBLICATIONS

International Search Report, issued in PCT/NL2018/050324, dated Sep. 27, 2018.
Written Opinion of the International Searching Authority, issued in PCT/NL2018/050324, dated Sep. 27, 2018.

* cited by examiner

SUSPENDED ROLLERCOASTER VEHICLE WITH ROTATIONAL LOCKAGE

FIELD OF THE INVENTION

The present invention relates to an amusement device, in particular a rollercoaster vehicle, more in particular a suspended rollercoaster vehicle.

The amusement device comprises a main structure, in particular a vehicle chassis, and a substructure. The substructure includes at least one passenger seat. The substructure is rotatable connected to the main structure by a coupling. The coupling includes a coupling ring and a coupling actuator for rotationally driving the substructure with respect to the main structure. The coupling actuator is connected to the main structure. The coupling ring is connected to substructure. Herewith, the substructure is driveable in rotation with respect to the main structure by the coupling actuator.

BACKGROUND OF THE INVENTION

EP1.201.280 discloses an installation for an amusement park, known as a rollercoaster, comprising a circuit formed by a rails. At least one vehicle travels along the rails. The vehicle comprises a first portion coupled with the rails and a second portion mounted with a mobile coupling on the first portion. The first portion allows the vehicle to move along the circuit. The second portion is arranged to be able to accommodate at least one passenger in at least one seat. Each seat has a seat and a back associated with a device for securing a passenger in the seat. When the vehicle travels along the circuit, the passenger hangs from under the rails. The plane of his back is not perpendicular to the plane of the track constituted by the rails. The coupling of the second portion of the vehicle with the first portion includes a slewing ring to enable the second portion to rotate about an axis substantially perpendicular to the plane of the seat back.

U.S. Pat. No. 6,220,965 discloses an example of such a rotatable coupling of a seat relative to a vehicle chassis. U.S. Pat. No. 6,220,965 discloses an amusement ride in which passengers sit in a vehicle which moves through a ride attraction. Each vehicle has a vehicle body with seats for accommodating riders. The vehicle body is supported on a turntable which in turn is supported on a vehicle chassis. The turntable includes a slewing ring attached to the vehicle body. A spin motor attached to the chassis is associated with the turntable for spinning the vehicle body relative to the chassis.

A drawback of such a turntable including a slewing ring is that this structure is not suitable to maintain the vehicle body stationary in a predetermined angular position with respect to the chassis. Vibrations occur when holding the vehicle body stationary.

SUMMARY OF THE INVENTION

The general object of the present invention is to at least partially eliminate the above mentioned drawbacks and/or to provide a useable alternative.

In particular, it is an object of the present invention to provide an amusement device with a rotational coupling which coupling includes a driven slewing ring in between a main structure and a substructure and which coupling can be properly hold at a predetermined stationary position by a mechanism having a long lifetime, such that a frequent maintenance to components is not necessary.

More in particular, it is an object of the invention to provide a suspended rollercoaster vehicle comprising such a coupling for rotating a passenger seat relative to a vehicle chassis in which the coupling can be blocked at an arbitrary stationary angular position.

According to the invention, this object is achieved by an amusement device of the present invention.

According to the invention, an amusement device is provided which comprises a main structure and a substructure. The substructure is arranged for carrying at least one passenger. The substructure includes at least one passenger seat. The substructure is connected by a bearing to the main structure. The bearing allows the substructure to rotate with respect to the main structure. The bearing supports the substructure with respect to the main structure and defines a rotational axis.

The main structure is for example a vehicle chassis of a roller coaster vehicle. The substructure is rotatable connected to the main structure by a coupling. The coupling includes a coupling ring and a coupling actuator, e.g. an electric spin motor or a pneumatic or hydraulic cylinder, for rotationally driving the substructure with respect to the main structure. The coupling actuator is preferably connected to the main structure and the coupling ring is preferably connected to the substructure, such that the substructure is driveable in rotation by the coupling actuator. Alternatively, it is conceivable that the coupling actuator is connected to the substructure, and the coupling ring is connected to the main structure, such that the substructure is driveable in rotation by the coupling actuator.

The amusement device according to the invention further comprises a lockage for rotationally locking the coupling ring with respect to the main structure. The lockage may be connected to one of the main structure and substructure. The lockage is positioned opposite an outer end face of the coupling ring. The end face of the coupling ring is toothed to enable a toothed engagement of the coupling ring.

The lockage comprises a lock element and an lockage actuator. The lockage actuator is arranged for actuating the lock element.

The lock element comprises a toothed end face which is arranged to engage with the toothed end face of the coupling ring. The end face of the lock element has teeth in correspondence with teeth of the end face of the coupling ring. The lock element is axially movable with respect to the lockage actuator. The lock element is rotationally constrained with respect to the lockage actuator, e.g. by a form-closure. The lock element is connected in a non-rotatable manner with respect to the lockage actuator.

The lockage actuator is preferably fixed to the main structure or may alternatively be connected to the substructure. The lockage actuator is preferably fixed to the main structure to simplify an electrical wiring of the amusement device. The lockage actuator is an electromagnetic lockage actuator. The lockage actuator is co-operatively positioned with respect to the lock element, in particular opposite the lock element. The lock element is positioned in between the lockage actuator and the coupling ring. The lockage actuator houses at least one spring and at least one electromagnet.

The at least one spring is arranged for axially moving the lock element with respect to the lockage actuator. The at least one spring is arranged to axially move the lock element away from the lockage actuator to allow the lock element to engage with the coupling ring. The at least one spring exerts a spring force on the lock element in a direction away from the lockage actuator towards the coupling ring.

The at least one electromagnet of the lockage actuator is arranged for axially moving the lock element towards the electromagnet and away from the coupling ring to disengage the lock element from the coupling ring. The at least one electromagnet is arranged to attract the lock element to the lockage actuator. The at least one electromagnet is arranged to withdraw the lock element from the coupling ring. When actuated, the at least one electromagnet axially moves the lock element away from the coupling ring to disengage the coupling ring. Without actuation of the at least one electromagnet, e.g. in case of an electrical breakdown, the at least one spring axially moves the locking element towards the coupling ring to engage the coupling ring.

The lockage of the amusement device according to the invention may provide several advantages in a passenger's experience when enjoying a ride with the amusement device.

Advantageously, according to the invention the coupling with lockage provides a solid, stable and low maintenance rotational locking of the passenger seat of the amusement device. Due to the toothed engagement, the passenger seat can be maintained reliably at a fixed angular position with respect to the main structure. The toothed engagement provides a form-closure in between the coupling ring and lock element which provides a firm connection to prevent any slippage. This will contribute to a passenger's feeling of comfort when making a ride with the amusement device.

The engagement of the lock element with the coupling ring is biased by the at least one spring of the lockage actuator. An advantage of the biased toothed engagement is that any play in between the lock element and coupling ring may be eliminated. Eliminating play contributes to a reduction of vibrations in a stationary position of the passenger seat which further contributes to a comfort of passengers sitting in the amusement device. Additionally, the biased toothed engagement is hardly vulnerable to a short term wear out. A reduced wear reduces a need for servicing. Replacing components during maintenance affects operational usability of the amusement device. An amusement device which is out of service due to maintenance renders a loss of turnover. Therefore, a low maintenance of the amusement device as provided by amusement device according to the invention is advantageous.

By actuating the electromagnet, the lock element is withdrawn from the coupling ring and the substructure is free to rotate with respect to the main structure about the rotational axis. The engagement in between the lock element and the coupling ring occurs when the electromagnet is no longer actuated. This means that also in case of an electrical breakdown, the lock element will engage to lock to prevent a possible rotational movement of the passenger seat. Advantageously, this contributes to a safety of the amusement device in that the lockage may prevent the passenger seat to rotate to an arbitrary rotational position in case of an electrical breakdown.

Preferably, the coupling actuator is an electric motor for driving the coupling ring. Preferably, the coupling motor is a spin motor and the coupling ring comprises an external slewing ring in which the spin motor is arranged for engaging with an outer circumference of the slewing ring. Preferably, the slewing ring is an external slewing ring which includes teeth formed on an outer circumferential surface of the ring. Advantageously, the spin motor allows a full rotation of the slewing ring and a connected substructure. Preferably, the coupling motor is a spin motor adapted to directly engage with the slewing ring. In an embodiment, the coupling ring may be formed by the slewing ring as a one piece item including the toothed end face. Preferably, the coupling ring is formed by an assembly of a slewing ring and a separate ring shaped item providing the toothed end face of the coupling ring, in which the ring shaped item is mechanically mounted e.g. by bolts to the slewing ring.

Preferably, the coupling ring is a circular ring. Preferably, the coupling ring is a one piece item. In an alternative embodiment, the ring shape of the coupling ring is defined by at least two coupling ring segments. The separate coupling ring segments are positioned with respect to each other to form a ring shape. The separate coupling ring segments may be spaced with respect to each other or may be positioned side by side in an abutting engagement.

In an embodiment of the amusement device according to the invention, the lock element is ring shaped. Preferably, the lock element is a one piece item. Preferably, the lock element has a full circular ring shape. The ring shaped lock element engages to the coupling ring which engagement forms an assembly which is a rigid in a rotational direction. Herewith, advantageously, a rigid rotational lockage may be obtained. The ring shaped lock element may have an end face which is toothed along a portion of the circumference, but preferably the end face is toothed along the whole circumference. Preferably, both the coupling ring and the lock element toothed end faces include teeth along their whole circumference. Herewith, advantageously, a strong engagement provided by a plurality of teeth can be obtained.

In an embodiment of the amusement device according to the invention, the lock element has an end face which is oriented perpendicular to a centre line of the lock element. The centre line of the lock element is in alignment with an axial axis of the coupling. The end face is oriented perpendicular with respect to the direction of movement of the lock element. Instead of an inclined lock element end face which may slidably engage with the coupling ring about a certain stroke, the perpendicular oriented end faces of the lock element and coupling ring engage frontally and instantly with each other. The frontal engagement provides a direct behaviour of the rotational lockage. Advantageously, such a frontal and instant engagement contributes to a fast rotational lockage of the passenger seat which further contributes to a feeling of comfort of the passenger.

In an embodiment of the amusement device according to the invention, the toothed end face of the lock element has teeth with a tooth size including a chordal pitch of at most 10 mm. Such a small tooth size contributes to an accurate rotational lockage of the passenger seat. In case that a rotational lockage is needed, the passenger seat may hardly move in rotation which contributes to the feeling of comfort of the passenger.

In an embodiment of the amusement device according to the invention, the lock element is resiliently connected by a membrane to the main structure. The membrane is plate shaped. Preferably, the membrane is flat in its initial unbiased condition. The membrane may be manufactured out of a sheet by a cutting operation, like lasercutting. The membrane may e.g. be manufactured out of a sheet having a thickness of at most 2 mm. The membrane is sufficient rigid in a plane of the membrane itself to constrain a rotational movement of the lock element with respect to the main structure. The membrane is sufficient flexible in a normal direction to this plane to allow an axial movement of the lock element with respect to the main structure. The membrane may include a plurality of through apertures to increase the flexibility of the membrane while maintaining sufficient rotational rigidity. Advantageously, the membrane provides a low maintenance component of the amusement device which contributes to an operational lifetime of the amusement device.

In an embodiment of the amusement device according to the invention, the lockage actuator is a ring shaped. Preferably, the lockage actuator has a ring-shaped coil chamber for housing a coil of an electromagnet. Preferably, the lockage actuator comprises only a single coil in a single ring-shaped coil chamber positioned around a centreline of the lockage actuator. Herewith, a simple and effective configuration of the lockage actuator is obtained.

In an embodiment of the amusement device according to the invention, the at least one spring of the lockage actuator is positioned radially outwardly with respect to the coil chamber.

In an embodiment of the amusement device according to the invention, the lockage is provided with a blockage member to prevent a release of the substructure from the main structure in an axial direction. During an assembly of the substructure to the main structure, the blockage member of the lockage is mounted to the main structure after mounting the substructure to the main structure. The lockage and the main structure enclose the substructure in between them and provide a form-closure to the substructure, such that the substructure cannot escape in an axial direction. The blockage member forms a stopper to the substructure. As a safety measure, the lockage prevents a loosening of the substructure.

Advantageously, in case of a failure e.g. a broken bearing which is arranged for supporting the substructure, the substructure remains enclosed in between the main structure and the lockage, such that the substructure cannot get released from the main structure.

In an embodiment of the amusement device according to the invention, the lockage actuator comprises the blockage member, which blockage member is positioned at an outer circumference. The blockage member is preferably formed by a shoulder extending radially away from the lockage actuator. The shoulder is integral with the lockage actuator. The blockage member is incorporated in the lockage actuator. In particular, the shoulder of the lockage actuator cooperates with a portion of the substructure, wherein the shoulder has an outer radial dimension which is a larger than an inner radial dimension of the cooperating portion of the substructure. The shoulder encloses the substructure and provides the form-closure.

In an embodiment of the amusement device according to the invention, the amusement device is a rollercoaster vehicle, in particular a suspended rollercoaster vehicle. The main structure is a vehicle chassis which comprises a wheel set for riding the rollercoaster vehicle along a track. The substructure is a passenger carrier including at least one passenger seat which passenger carrier is rotatable connected to the vehicle chassis.

The invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the appended claims, in which:

DETAILED DESCRIPTION OF THE DRAWINGS

Figure 1A:
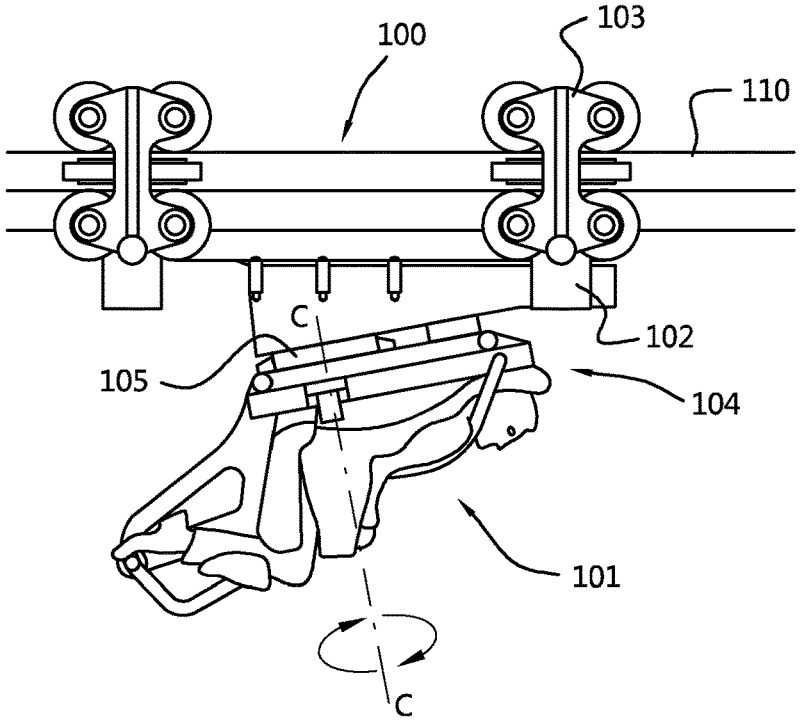
FIG. 1A shows a side view and of a suspended rollercoaster having a passenger seat rotatable connected to a vehicle chassis.

Identical reference signs are used in the drawings to indicate identical or functionally similar components. To facilitate comprehension of the description and of the claims the words vertical, horizontal, longitudinal, cross-sectional—with reference to the gravity—are used in a non-limiting way.

FIG. 1A shows a side view of an amusement device configured as a suspended rollercoaster 100. The rollercoaster 100 includes at least one rollercoaster vehicle 101 which is connected to a rollercoaster track 110. In operation, the vehicle 101 travels along the track 110 which forms a circuit.

The vehicle 101 comprises a vehicle chassis 102 which is connected by a wheel set 103 to the track 110. Further, the vehicle 101 comprises a passenger carrier 104 for carrying at least one passenger. The passenger carrier 104 is rotatably mounted to the vehicle chassis 102 by a rotational coupling 105. The coupling 105 allows the passenger carrier 104 to rotate about a coupling axis C-C with respect to the vehicle chassis 102 as illustrated by the arrows.

Figure 1B:
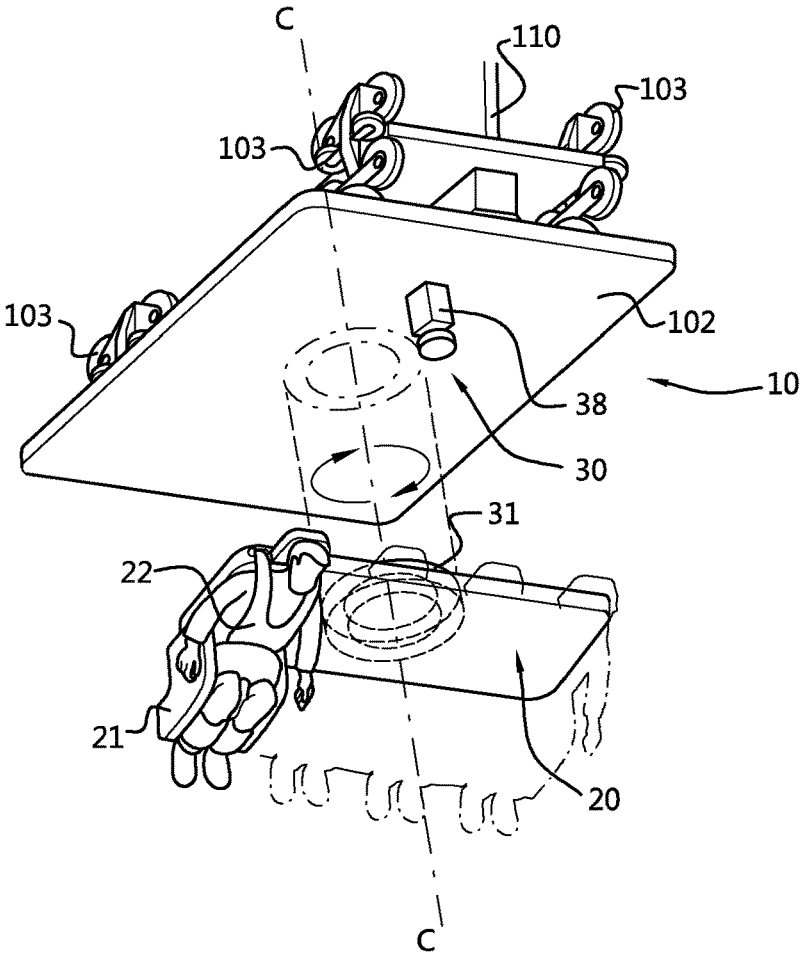
FIG. 1B shows an exploded view of the suspended rollercoaster from FIG. 1A illustrating the coupling in between the passenger seat and the vehicle chassis.

FIG. 1B shows the suspended rollercoaster vehicle of FIG. 1A in further detail. FIG. 1B shows an exploded view to further illustrate the coupling 105. The vehicle chassis 102 forms a main structure 10. The passenger carrier 104 forms a substructure 20 which comprises at least one passenger seat 21. The passenger seat 21 is provided with a passenger restraint 22 to hold the passenger in the passenger seat during a ride.

The substructure 20 is rotatably connected to the main structure 10 by a coupling 30. The coupling 30 is positioned in between the main structure 10 and the substructure 20. The coupling 30 comprises a coupling ring 31 which is connected to the substructure 20 and a coupling actuator 37 which is connected to the main structure 10. The coupling actuator 37 is arranged for rotationally driving the coupling ring 31. The arrangement of the coupling 30 allows the substructure 20 to rotate about 360°.

Figure 2A:
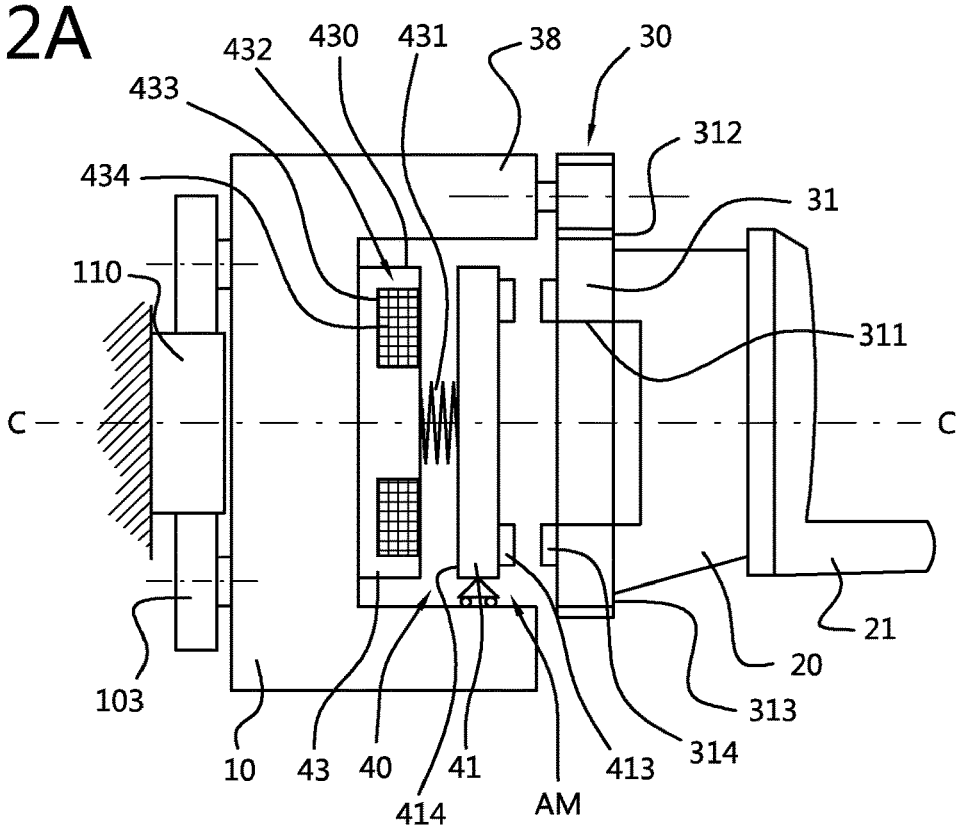
FIGS. 2A and 2B each show a schematic view of an amusement device including a rotational lockage for locking a rotational movement of a substructure relative to a main structure.

FIG. 2A shows a schematic view of the amusement device according to the invention. The coupling 30 is illustrated in further detail. The coupling ring 31 is connected to the substructure 20. The coupling ring 31 is here a slewing ring. The slewing ring is an external slewing ring which is arranged for an engagement by the coupling actuator which is here a spin motor 38 at an outer circumference of the ring. The coupling ring 31 has a smooth inner circumferential surface 311 and an outer circumferential surface 312 which is toothed. The coupling motor 38 engages at the outer circumference of the coupling ring 31. The coupling ring 31 has an outer end face 313 which is mounted to a mounting surface of the substructure 20. The coupling ring 31 has an inner end face 314 which is directed to the main structure 10. The inner end face 314 is toothed along its circumference.

Further, the amusement device comprises a lockage 40 for locking the coupling ring 31 of the coupling 30. The coupling ring 31 can be locked in rotation with respect to the main structure 10 by the lockage 40. The lockage 40 forms a rotational lockage to the coupling ring 31. The lockage 40 is connected to the main structure 10. The lockage 40 is positioned opposite the toothed end face 314 of the coupling ring 31. The lockage 40 is arranged to engage to the toothed end face 314 of the coupling ring 31 to lock the substructure in rotation.

The lockage 40 comprises a lock element 41 and an lockage actuator 43. The lockage actuator 43 is positioned opposite the lock element 41. The lockage actuator 43 is arranged to move the lock element 41 in an axial direction.

The lock element 41 is axially movable connected to the main structure as indicated by the symbol AM. The symbol AM means a freedom in translation but a constraint in rotation. The lock element 41 is axially movable over an axial stroke. Preferably, the axial stroke is at least 2 mm and at most 15 mm, in particular at most 10 mm. The lock element 41 is movable to and fro the coupling ring 31. The coupling ring 31 is axially fixed in position with respect to the main structure 10. The lock element 41 is movable towards the inner end face 314 of the coupling ring 31 to establish a toothed engagement in between the locking element 41 and coupling ring 31. The lock element 41 has an outer toothed lock element end face which is mated with an inner toothed coupling ring end face. Preferably, the end faces are perpendicular end faces with respect to the axial axis to provide a frontal and instant engagement.

Instead of an engagement based on a friction force, the toothed engagement provides a form-closure in between the components which increases a reliability of the lockage. Preferably, the toothed engagement is provided over 360° which allows a lockage over a full-turn range. Preferably, a fine teeth profile is provided to improve a positional accuracy of engagement. Preferably, a teeth profile is provided including a chordal pitch of at most 10 mm.

The lock element 41 is biased by the opposite positioned lockage actuator 43. The lockage actuator 43 co-operates with the lock element 41. The lockage actuator 43 comprises at least one spring 431 for generating a spring force onto the lock element 41. Here, the spring 431 is a spiral spring which provides a pushing force onto the lock element 41. The spring 431 is positioned in between a housing of the lockage actuator 43 and the lock element 41. The spring 431 is arranged for pushing the lock element 41 away from the housing of the lockage actuator 43.

Further, the lockage actuator 43 comprises at least one electromagnet 432 which is arranged to provide a pulling force onto the lock element 41. The electromagnet 432 comprises a coil 434 which is received in a coil chamber 433 of the lockage actuator 43. Preferably, the lockage actuator 43 comprises only a single electromagnet 432, in which the coil chamber 433 is a ring shaped chamber around a central axis of the lockage actuator 43. The coil 434 is formed by a wound electric wire inside the ring shaped chamber.

By actuating the at least one electromagnet 432, the lock element 41 is attracted to the lockage actuator 43. By actuating the at least one electromagnet 432, the lock element 41 is withdrawn from the coupling ring 31. By actuating the at least one electromagnet 432, the lock element 41 disengages from the coupling ring 31 and the lockage is released.

Figure 2B:
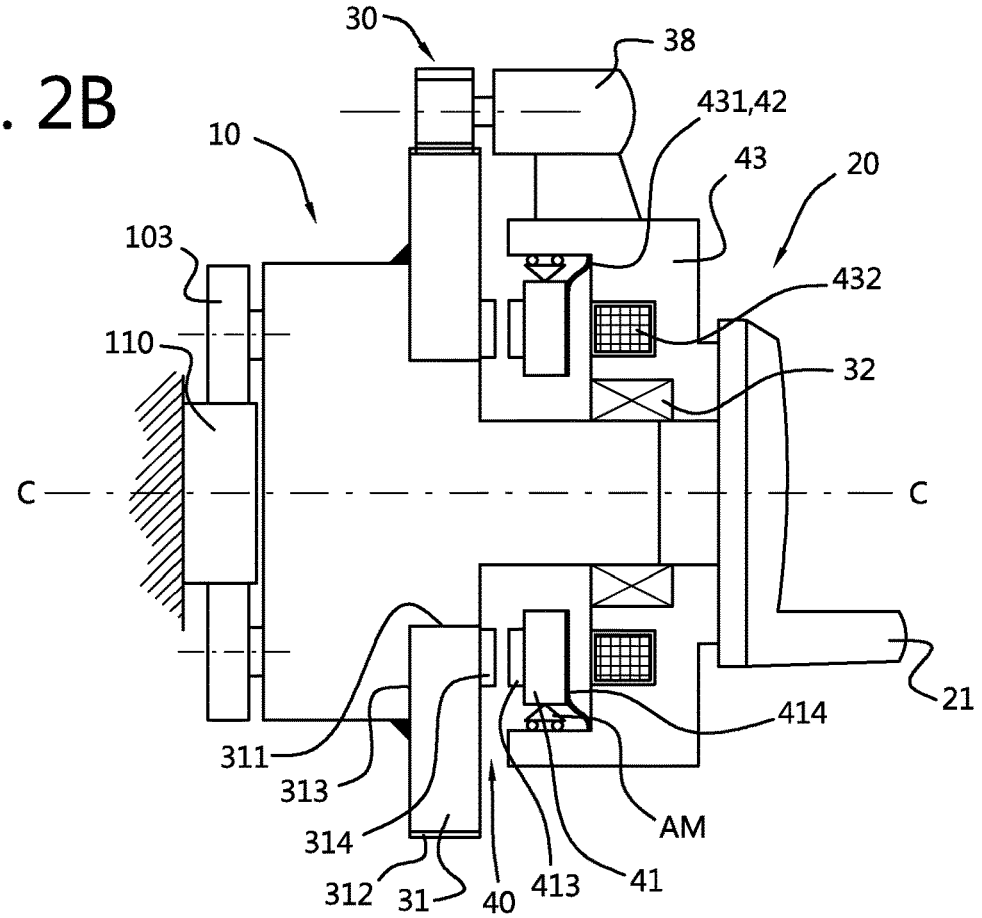

FIG. 2B shows a schematic view of a variant on the embodiment of FIG. 2A according to the invention, in which the coupling ring 31 is part of the main structure 10 and in which the lockage actuator 43 of the lockage 40 is part of the rotatable substructure 20.

In the embodiment, the coupling ring 31 is a slewing ring. The slewing ring is an external slewing ring which is arranged for an engagement by the coupling actuator. Here, the coupling actuator is a spin motor 38 which is positioned at an outer circumference of the coupling ring 31. The coupling ring 31 has an inner circumferential surface 311. The main structure 10 extends through the coupling ring 31 and along the inner circumferential surface 311. The coupling ring 31 has an outer circumferential surface 312 which is toothed. The coupling motor 38 is mounted to the substructure 20 and engages with the outer circumferential surface 312 for driving the substructure in rotation.

The coupling ring 31 has an outer end face 313 which is mounted to a mounting surface of the main structure 10. The coupling ring 31 has an inner end face 314 which is directed to the substructure 20. The inner end face 314 is toothed along its circumference.

The amusement device comprises a lockage 40 for locking the substructure 20 with respect to the fixed coupling ring 31 of the coupling 30. The substructure 20 can be locked in rotation with respect to the main structure 10 by the lockage 40. The lockage 40 forms a rotational lockage to the coupling ring 31. The lockage 40 is here connected to the substructure 20. The lockage 40 is positioned opposite the toothed end face 314 of the coupling ring 31. The lockage 40 is arranged to engage with the toothed end face 314 of the coupling ring 31 to lock the substructure 20 in rotation with respect to the main structure 10.

The lockage 40 comprises a lock element 41 and an lockage actuator 43. The lockage actuator 43 is positioned opposite the lock element 41. The lockage actuator 43 is arranged to move the lock element 41 in an axial direction.

The lock element 41 is axially movable connected to the substructure 20 as indicated by the symbol AM. The symbol AM means a freedom in translation but a constraint in rotation about the axis C-C. The lock element 41 is axially movable over an axial stroke. Preferably, the axial stroke is at least 2 mm and at most 15 mm, in particular at most 10 mm. The lock element 41 is movable to and fro the coupling ring 31.

The coupling ring 31 is axially fixed in position with respect to the main structure 10. The lock element 41 is movable towards the inner end face 314 of the coupling ring 31 to establish a toothed engagement in between the locking element 41 and coupling ring 31. The lock element 41 has an outer toothed lock element end face 413 which is mated with the inner toothed coupling ring end face 314. Preferably, the end faces are perpendicular end faces with respect to the axial axis to provide a frontal and instant engagement.

Instead of an engagement based on a friction force, the toothed engagement provides a form-closure in between the components which increases a reliability of the lockage. Preferably, the toothed engagement is provided over 360° which allows a lockage over a full-turn range. Preferably, a fine teeth profile is provided to improve a positional accuracy of engagement. Preferably, a teeth profile is provided including a chordal pitch of at most 10 mm.

The lock element 41 is biased by the opposite positioned lockage actuator 43. The lockage actuator 43 co-operates with the lock element 41. The lockage actuator 43 comprises at least one spring 431 for generating a spring force onto the lock element 41. Here, the spring 431 is a membrane 24 which provides a pushing force onto the lock element 41. The membrane 42 is positioned in between the lockage actuator 43 and the lock element 41. The membrane 42 is arranged for pushing the lock element 41 away from the lockage actuator 43 and provides a rotational constraint to the lock element 41 with respect to the lockage actuator 43.

Further, the lockage actuator 43 comprises at least one electromagnet 432 which is arranged to provide a pulling force onto the lock element 41. The electromagnet 432 comprises a coil 434 which is received in a coil chamber 433 of the lockage actuator 43. Preferably, the lockage actuator 43 comprises only a single electromagnet 432, in which the coil chamber 433 is a ring shaped chamber around a central axis of the lockage actuator 43. The coil 434 is formed by a wound electric wire inside the ring shaped chamber.

By actuating the at least one electromagnet 432, the lock element 41 is attracted to the electromagnet 432. By actuating the at least one electromagnet 432, the lock element 41 is withdrawn from the coupling ring 31. By actuating the at least one electromagnet 432, the lock element 41 disengages from the coupling ring 31 and the lockage 40 is released.

Figure 3A:
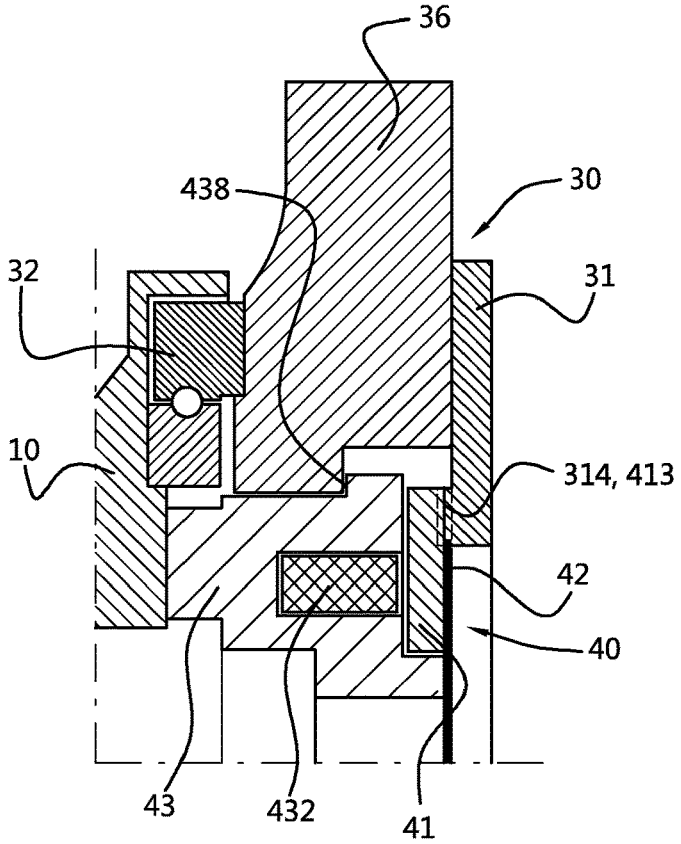
FIG. 3A shows in a schematic view of the amusement device according to the invention, wherein the coupling is provided with a lockage for locking the passenger seat.

FIG. 3A shows a cross sectional view of a configuration of a lockage 40 for locking a coupling ring 31 in a more detailed view. Here, the coupling comprises a coupling ring 31 which is mounted on a slewing ring 36. The slewing ring 36 has an outer circumference provided with teeth for an engagement with a coupling actuator. The coupling ring 31 and the slewing ring 36 are part of a substructure 20 which is rotatable with respect to a main structure 10. The substructure 20 is supported by a bearing 32 with respect to the main structure 10. The bearing 32 enables a rotational movement of the substructure 20 with respect to the main structure 10.

The coupling ring 31 has an inner toothed end face 314. The toothed end face 314 of the coupling ring 31 is directed inwardly to the main structure 10. The lockage 40 comprises a lock element 41 which has an toothed outer end face 413. The toothed end faces of the locking element 41 and the coupling ring 31 are arranged in correspondence with each other. Here, the lock element 41 is illustrated in toothed engagement with the end face 314 of the coupling ring 31. The toothed engagement is oriented in perpendicular with the direction of movement of the lock element 41, such that a frontal engagement and instant lockage is obtained by the lockage 40.

Figure 3B:
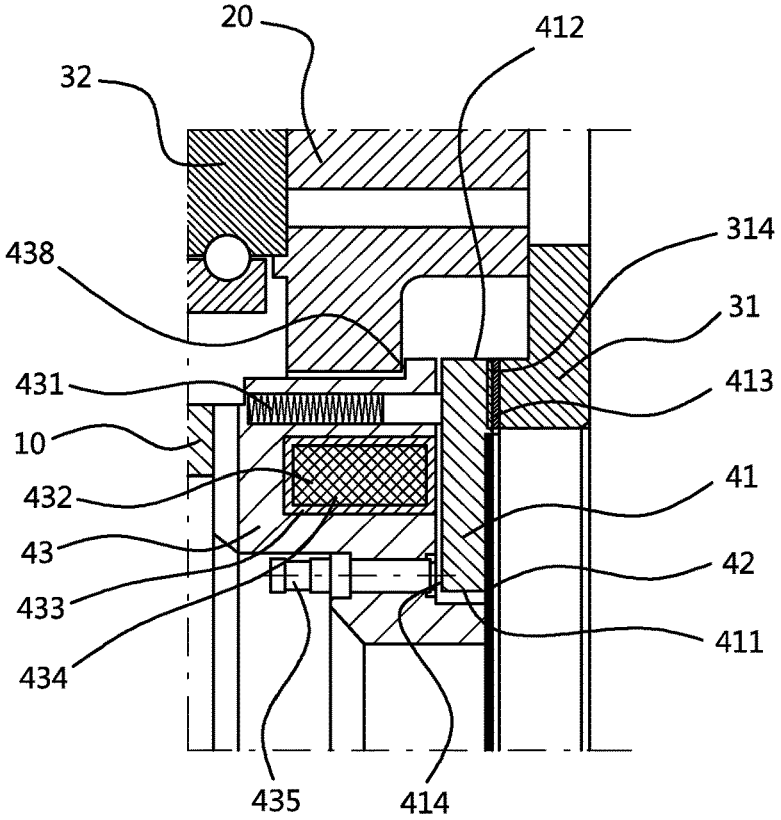
FIG. 3B shows a more detailed view of the lockage including components like a spring and stud to provide a spring force and a stopper to the lock element.

FIG. 3B shows a view of a lockage 40 to illustrate the lockage 40 of the substructure 20 in more technical detail in which additional technical components of the lockage actuator are shown.

The lock element 41 is connected to the main structure 10 by a membrane 42 and the lockage actuator 43. The membrane 42 is ring shaped. At an inner region of the membrane, the membrane is mounted to the lockage actuator 43. At an outer region of the membrane, the membrane 42 is mounted to the lock element 41. The membrane 42 is a plate shaped component which is flexible in the axial direction to allow an axial movement of the lock element 41 with respect to the lockage actuator 43. The membrane 42 is resilient in the axial direction. The membrane 42 is torsially rigid to provide a rotational constrain to the lock element 41 with respect to the lockage actuator 43. In engagement of the lock element 41 with the coupling ring 31, the membrane 42 prevents a rotational movement of the coupling ring 31.

The lock element 41 is ring shaped including an inner and outer circumferential surface 411, 412 and an inner and outer end face 413, 414. The inner end face 414 is directed towards the lockage actuator 43 and the outer end face 413 is directed to the coupling ring 31. The membrane 42 is connected at an inner region of the outer end face 413.

The lockage actuator 43 is a ring shaped component. The lockage actuator 43 is mounted to the main structure 10. The lockage actuator 43 has a housing which is arranged for housing at least one electromagnet 432 and at least one spring 431. Here, the housing of the lockage actuator 43 is a one piece item. The lockage actuator 43 has a ring shaped coil chamber 433 for receiving a coil 434. The lockage actuator 43 has at least one blind hole for receiving the at least one spring 431. Further, the lockage actuator 43 comprises at least one adjustable stud 435 for adjusting a position of the lock element 41 with respect to the lockage actuator 43 when actuating the electromagnet 432. Here, the coil 434 is positioned in between the at least one spring 431 and the at least one adjustable stud 435. The at least one spring 431 is positioned radially outwardly with respect to the coil chamber 433 and the at least one adjustable stud 435 is positioned radially inwardly with respect to the coil chamber 433.

FIG. 3B shows the blocking member 438 in further detail. The blocking member 438 is integral with the lockage actuator 43. The blocking member 438 is formed by an externally extending shoulder positioned at the outer circumference of the housing of the lockage actuator 43. The blocking member 438 co-operates with an internally extending portion of the substructure 20. The shoulder has an outer radial dimension which is larger than an inner radial dimension of the cooperating portion of the substructure. Herewith, the substructure 20 is enclosed in between the lockage 40, in particular the lockage actuator 43, and the main structure 10. The substructure 20 is enclosed by a form-closure. A small gap is provided in the axial direction in between the locking member for 38 and the portion of the substructure 20 to allow a relative rotational movement in between these components. The blocking member 438 provides a limitation to a possible axial movement of the substructure 20 with respect the main structure 10. Such an axial movement may e.g. occur in case of a damage to the bearing 32. In such case, the blocking member 438 prevents an axial loosening of the substructure 20 from the main structure 10.

Thus, according to the invention an amusement device 100 comprising a substructure 20 with a passenger seat 21 is provided, which substructure is rotatable relative to a main structure 10 by a bearing 32 and a coupling 30. The coupling has a coupling ring 31 and a coupling actuator 37 for driving the substructure 20 about a coupling axis C-C. The coupling ring has an end face 314 which is toothed to engage with a toothed end face of a lock element 41 of a lockage 40 for rotationally locking the coupling ring 31 with respect to the main structure 10. The lock element 41 is axially movable and rotationally constrained with respect to an lockage actuator 43. A spring 431 and electromagnet 432 respectively serve for axially moving the lock element. During a normal ride, the lockage is open and all kind of rotations are possible, but in case of an interference the lockage engages for safety.

It is noted that the term "comprising" (and grammatical variations thereof) is used in this specification in the inclusive sense of "having" or "including", and not in the exclusive sense of "consisting only of".

Features and aspects described for or in relation with a particular embodiment may be suitably combined with features and aspects of other embodiments, unless explicitly stated otherwise.

The invention is disclosed with reference to embodiments of the amusement device according to the invention. Reference is expressly made to the fact that, after reading the description, a person skilled in the art may wish to make changes or adaptations that are possible from a technical viewpoint, but that said changes or adaptations do not fall outside the scope of protection of the invention as defined in the attached claims. The person skilled in the art must understand that it is possible to make various adaptations from a technical viewpoint and to replace elements with equivalents without thereby departing from the essence of the invention. It is in particular possible to make changes with respect to the illustrated embodiments, which do not depart from the essence of the invention and thus remain within the teaching of the invention. The invention is therefore not restricted to the illustrated and described embodiments. The scope of protection of the invention will cover all embodiments which fall within the definition of the attached claims.

List of reference signs:

| | |
|---|---|
| 100 | amusement device |
| 100 | suspended rollercoaster vehicle |
| 101 | rollercoaster vehicle |
| 102 | vehicle chassis |
| 103 | wheel set |
| 104 | passenger carrier |
| 105 | rotational coupling |
| 110 | rollercoaster track |
| 10 | main structure |
| 11 | bearing |
| 20 | substructure |
| 21 | passenger seat |
| 22 | passenger restraint |
| 30 | coupling |
| 31 | coupling ring |
| 311 | inner circumferential surface |
| 312 | outer circumferential surface |
| 313 | outer coupling ring end face |
| 314 | inner coupling ring end face |
| 32 | bearing |
| 36 | slewing ring |
| 37 | coupling actuator |
| 38 | coupling spin motor |
| 40 | lockage |
| 41 | lock element |
| 411 | inner circumferential surface |
| 412 | outer circumferential surface |
| 413 | outer lock element end face |
| 414 | inner lock element end face |
| 42 | membrane |
| 43 | lockage actuator |
| 430 | housing |
| 431 | spring |
| 432 | electromagnet |
| 433 | coil chamber |
| 435 | stud |
| 434 | coil |
| 438 | blockage member |
| AM | axially movable |
| C-C | coupling axis |

The invention claimed is:

1. An amusement device comprising;

a substructure arranged for carrying at least one passenger, the substructure being connected by a bearing to a main structure, the bearing allowing the substructure to rotate with respect to the main structure about a rotational axis, wherein the substructure includes at least one passenger seat and the substructure is rotationally connected to the main structure by a coupling, the coupling including a coupling ring and a coupling actuator for rotationally driving the substructure about a coupling axis C-C aligned with the rotational axis, wherein the coupling actuator and the coupling ring are respectively connected to one of the main structure and the substructure, such that the substructure is driveable in rotation with respect to the main structure by the coupling actuator, wherein the coupling ring has toothed end face, wherein the amusement device further comprises:

a lockage for rotationally locking the coupling ring with respect to the main structure, wherein the lockage is connected to one of the main structure and the substructure and wherein the lockage is positioned opposite the end face of the coupling ring to engage the toothed end face of the coupling ring, such that in an engagement of the lockage with the coupling ring, the coupling ring is locked in rotation about the coupling axis C-C, wherein the lockage comprises a lock element and an electromagnetic lockage actuator for actuating the lock element, wherein the lock element includes a lock element toothed end face arranged to engage with the coupling ring toothed end face, wherein the lock element is axially movable along the coupling axis C-C and rotationally constrained with respect to the lockage actuator, wherein the lockage actuator is fixed to one of the main structure and the substructure and co-operatively positioned with respect to the lock element, wherein the lockage actuator includes:

at least one electromagnet for axially moving the lock element towards the electromagnet to disengage the lock element from the coupling ring; and at least one spring for axially moving the lock element away from an electromagnet to allow the lock element to engage with the coupling ring.

2. The amusement device according to claim 1, wherein the lock element has a full circular ring shape.

3. The amusement device according to claim 1, wherein the end face of the lock element is oriented perpendicular with respect to an axial axis.

4. The amusement device according to claim 1, wherein the toothed end face of the lock element has a tooth size including a chordal pitch of at most 10 mm.

5. The amusement device according to claim 1, wherein the lock element is resiliently connected by a membrane to the main structure.

6. The amusement device according to claim 1, wherein the lockage actuator is ring-shaped.

7. The amusement device according to claim 1, wherein the lockage actuator has a coil chamber for housing a coil of the electromagnet.

8. The amusement device according to claim 7, wherein the coil chamber is ring-shaped.

9. The amusement device according to claim 7, wherein the at least one spring of the lockage actuator is positioned radially outwardly with respect to the coil chamber.

10. The amusement device according to claim 1, wherein the substructure is enclosed in between the lockage and the main structure by a form-closure to prevent an axial loosening of the substructure.

11. The amusement device according to claim 10, wherein the lockage comprises a blockage member at an outer circumference for blocking an axial movement of the substructure away from the main structure.

12. The amusement device according to claim 11, wherein the blockage member is formed by a shoulder of the lockage actuator, the shoulder providing a form-closure of the substructure with respect to the main structure.

13. The amusement device according to claim 12, wherein the shoulder of the lockage actuator cooperates with a portion of the substructure, and wherein the shoulder has an outer radial dimension larger than an inner radial dimension of the cooperating portion of the substructure.

14. The amusement device according to claim 1, wherein the amusement device is a rollercoaster vehicle, and wherein the main structure is a vehicle chassis, the chassis comprising a wheel set for riding the rollercoaster vehicle along a track.

15. The amusement device according to claim 10, wherein the lockage actuator comprises a blockage member at an outer circumference for blocking an axial movement of the substructure away from the main structure.

16. The amusement device according to claim 14, wherein the rollercoaster vehicle is a suspended rollercoaster vehicle.

17. The amusement device according to claim 2, wherein the end face of the lock-element is oriented perpendicular with respect to an axial axis.

18. The amusement device according to claim 2, wherein the toothed end face of the lock element has a tooth size including a chordal pitch of at most 10 mm.

19. The amusement device according to claim 3, wherein the toothed end face of the lock element has a tooth size including a chordal pitch of at most 10 mm.

20. The amusement device according to claim 2, wherein the lock element is resiliently connected by a membrane to the main structure.

* * * * *